US005829103A

United States Patent [19]

Allen

[11] Patent Number: 5,829,103

[45] Date of Patent: Nov. 3, 1998

[54] PENCIL HOLDER FOR SOFT BASEBALL TYPE HATS

[76] Inventor: Thomas E. Allen, 528 Farrington's Corner Rd., Hopkinton, N.H. 03229

[21] Appl. No.: 824,371

[22] Filed: Mar. 25, 1997

[51] Int. Cl.[6] ..... A44B 21/00; B43K 25/00

[52] U.S. Cl. ..... 24/11 R; 248/316.7; 24/3.12; 24/3.3; 224/247; D8/395; D2/866

[58] Field of Search ..... 24/3.11, 3.12, 24/10 R, 11 R, 11 HC, 11 PP, 11 CC, 339; 248/316.7, 902; D8/395, 396; D2/891; 224/181, 269, 247

[56] References Cited

U.S. PATENT DOCUMENTS

| | | | |
|---|---|---|---|
| D. 204,446 | 4/1966 | Bardow . | |
| 209,776 | 11/1878 | Rickly . | |
| D. 259,393 | 6/1981 | Kuru | D8/395 X |
| D. 305,297 | 1/1990 | O'Neill | D8/396 X |
| D. 308,935 | 7/1990 | Leatherman | D8/395 |
| D. 354,677 | 1/1995 | Troyer | D8/396 |
| 463,351 | 11/1891 | Elliot . | |
| 508,791 | 11/1893 | Washburn . | |
| 637,889 | 11/1899 | Parker . | |
| 743,399 | 11/1903 | Seebold et al. . | |
| 803,464 | 10/1905 | Beck . | |
| 873,701 | 12/1907 | Adams | 24/3.3 |
| 884,256 | 4/1908 | Addie . | |
| 1,425,089 | 8/1922 | Henry | 24/3.12 X |
| 1,481,984 | 1/1924 | Carnett . | |
| 1,704,075 | 3/1929 | Brown . | |
| 2,345,051 | 3/1944 | Jenson . | |
| 2,614,305 | 10/1952 | Yeardley | 24/3.12 X |
| 2,832,114 | 4/1958 | Mead | 24/10 |
| 3,204,313 | 9/1965 | Sée | D8/395 X |
| 3,769,663 | 11/1973 | Perl | 24/81 |
| 3,983,602 | 10/1976 | Barry | 24/11 R |
| 4,100,652 | 7/1978 | Carlson | 24/3.1 |
| 4,852,221 | 8/1989 | Antonucci | 24/10 R |
| 5,066,154 | 11/1991 | Renaud | 401/131 |
| 5,082,225 | 1/1992 | Nespoli | 248/316.7 X |
| 5,184,375 | 2/1993 | Hoyt | 24/3.12 |
| 5,217,294 | 6/1993 | Liston | 362/105 |
| 5,253,368 | 10/1993 | Blake | 2/209 |
| 5,332,090 | 7/1994 | Tucker | 248/316.7 X |
| 5,408,728 | 4/1995 | Wisniewski | 24/3.3 |
| 5,449,242 | 9/1995 | Salamone | 401/131 |
| 5,573,167 | 11/1996 | Bebb et al. | 224/247 X |
| 5,573,217 | 11/1996 | Garvey et al. | 248/902 X |

*Primary Examiner*—Randolph A. Reese
*Assistant Examiner*—Robert J. Sandy

[57] ABSTRACT

A pencil holder which can be detachably mounted to the sweat band area of a soft baseball type cap preferably formed in one piece of moulded plastic. It includes a base section arm (12), an outwardly and upwardly extending opposing outer arm (13) between which the pencil is frictionally held and an inwardly and upwardly extending opposing inner arm (11), which in combination with the base section arm (12), forms a clamp or clip which firmly grasps the sweat band area of the cap. All three arms extend end to end of the holder, forming in essence, two upwardly facing clamps or clips.

6 Claims, 2 Drawing Sheets

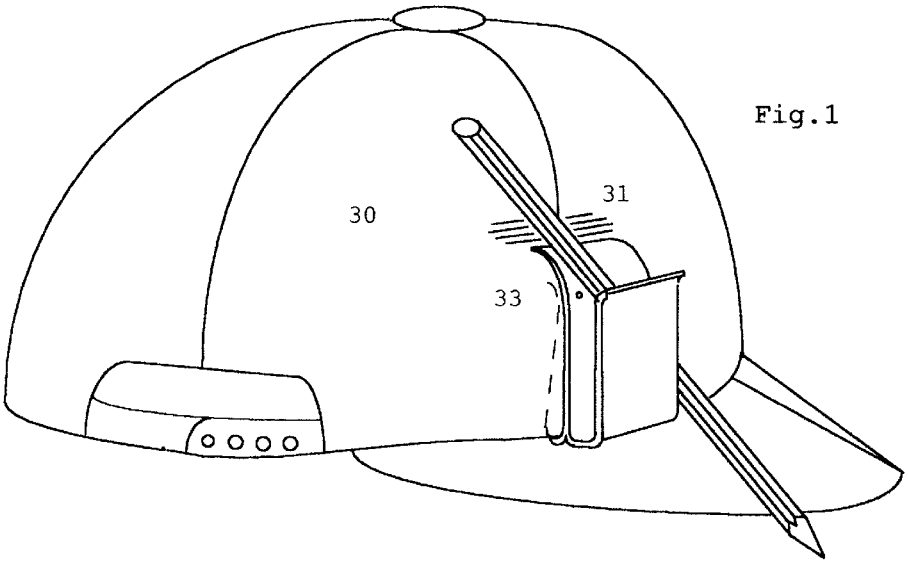
Fig.1
Fig.2
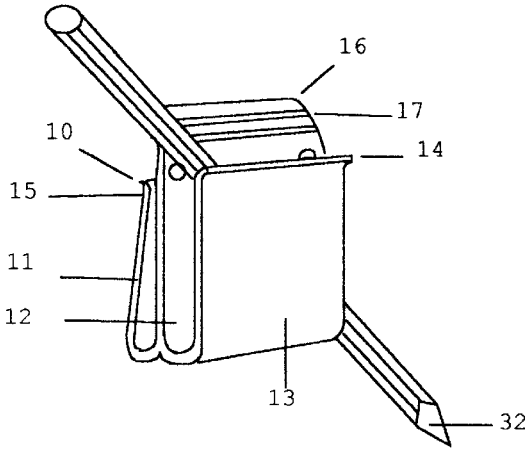
Fig.2A
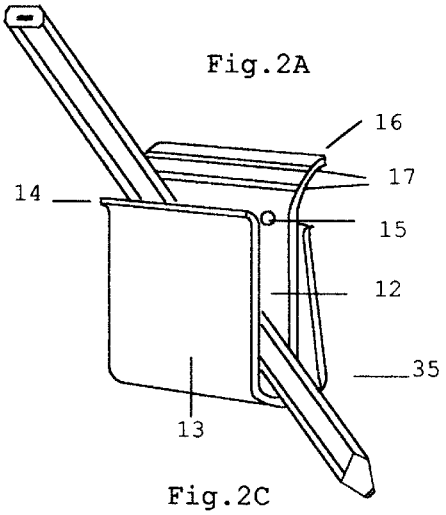
Fig.2B
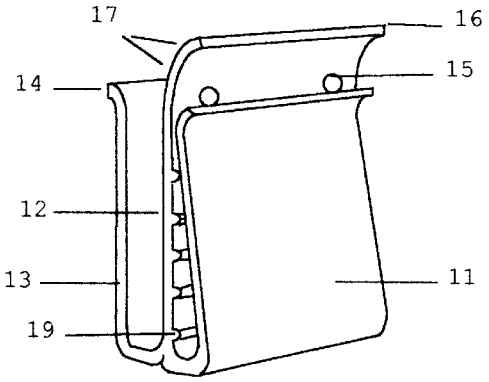
Fig.2C
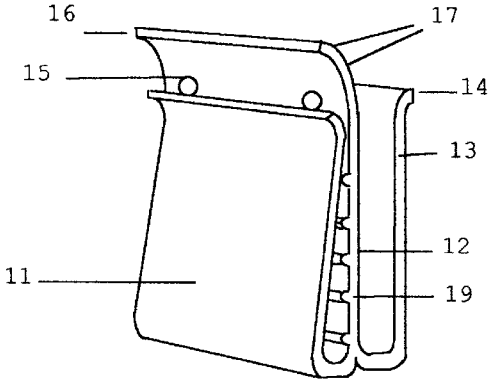

PENCIL HOLDER FOR SOFT BASEBALL TYPE HATS

BACKGROUND

1. Field of Invention

This invention relates to clip type pencil and like implement holders, specifically such holders which mount to soft baseball type hats and sweatband supported sun visors.

2. Description of Prior Art

In the building and service industry a very large number of workers store a pencil behind the ear for quick and ready access. This is far superior to a pocket or pouch because the person does not have to look to place and retrieve the pencil. If however, one is working with a cap, hard hat or safety glasses, both of which are mandatory in many shops, it is very difficult, if not impossible to store the pencil this way. So, they will either slide the pencil up between the sweat band of the hat and their head or, with glasses, slide the pencil up between the glass's bow and their head. This is, at best, a fair method until some adjustment is made to the hat or glasses. Then the pencil falls to the floor or worse, down two stories of staging where it must be either retrieved or replaced with another pencil, if the worker has thought to bring a spare. Either way, it is a costly endeavor in both wasted time and lost pencils.

Prior art is replete with a number of pen and pencil holders but none seem to replace the human ear or the area of a hat's sweat band. It is easy to place and retrieve the pencil from these areas. It is placed with one fast convenient and fluid motion. The exact opposite of the placement motion extracts the pencil. It is so easy that people will tolerate the frequently dropped pencil. The problem is that there is simply nothing that has truly mimicked the easy placement and removal motion of the pencil on the ear or under the hat band. A number of attempts have been patented; Rickly U.S. Pat. No. 209,776 Nov. 12, 1878, Seebold and Hurwitz U.S. Pat. No. 743,399 Nov. 3, 1903, Mead U.S. Pat. No. 2,832,114 Apr. 29, 1958, Antonucci U.S. Pat. No. 4,852,221 Aug. 1, 1989, and Salamone U.S. Pat. No. 5,449, 242 Sep. 12, 1995 to cite a few. None of these devices appear to have made a major contribution toward the solution of the problem of mimicking the motion and none of these same devices would seem to work well, if at all, if the user were wearing a baseball type cap, with or without eye glasses.

All the prior art devices use friction of two opposing surfaces to hold the pencil in place. In order to place the pencil in the device, the user must exert, with the pencil or other wise, a force greater than the two opposing surfaces. This excess force must be absorbed or resisted by something, otherwise the holding device will move. In prior art, the ear or a mass such as a hard hat has provided the resistance to the excess force. Consequently, the motion to place the pencil in the device has not been that troublesome to mimic. Retrieval of the pencil is a different matter.

If the frictional force of the holding device surfaces is strong enough to secure the pencil in the working world, it is usually too strong to easily release the pencil when the placement motion is reversed to extract it (see Antonucci Aug. 1989, Barry U.S. Pat. No. 3,983,602 Oct. 1976, Renaud U.S. Pat. No. 5,066,154 Nov. 1991, Salamone Sep. 1995). The force needed to remove the pencil from the holder will pull and jar whatever is attached to the device. This makes it uncomfortable and clumsy for the person using it. Consequently, a removal motion different than the placement motion is required (Mead) or some cumbersome procedure (Barry, Antonucci) or device, such as a ring around the ear (Salamone, Rickly) is contrived to solve the problem ie. overcoming the force holding the pencil. (see Seebold and Hurwitz Nov. 1903, Salamone Sep. 1995) Most people will not bother learning two different methods to place and remove a pencil in a device they have to buy and might misplace, nor will they tolerate something that is uncomfortable and could cause health problems, ie. rashes and blisters. (see Seebold and Hurwitz Nov. 1903, Salamone Sep. 1995). They will simply settle for the old familiar ear and hat band and continue to drop the pencil, wasting time and money.

As previously mentioned, many people wear lightweight, advertisement type soft baseball type caps when working and store the pencil under the sweat band of the hat. When it is inadvertently jarred or unconsciously adjusted the pencil falls out. Prior art shows this writer that this problem has not yet been identified, let alone solved. One invention by Blake, U.S. Pat. No. 5,253,368, permanently places a hook and loop strip on a baseball type hat to secure a pencil holding ring but this is for entertainment use and of little or no value in the work place. Referring to Blake's drawings it is obvious that placement of the pencil would be very troublesome given the small openings of the holder. In the dirty world of construction, any such device should be detachable, washable and trouble free.

The soft, light hat presents special problems in that it is just that, soft and light. On such a soft surface it is difficult to provide the rigidity and mass that an effortless, friction type pencil holder requires. If the pencil is removed with an upward motion the clip's holding force will many times severely displace or remove the lightweight hat as the pencil is pulled upward. This is because the sweat band breaks contact with the users head. Once loosened, there is no resistance to the pulling force. Unlike the hard hat or the ear, the light weight of the soft baseball type hat simply does not offer enough resistance to allow the pencil to be effortlessly removed without seriously disturbing the hat. This can be remedied by wearing the hat constantly snug but this can be very uncomfortable on hot days.

The solution to this particular problem is to make a holding device that will allow the pencil to be inserted and removed from the front by one swift forward or backward motion (see FIG. 1). By using this motion, front to back, the device mimics the motion used to place the pencil behind the ear or under the sweat band of the hat. The force of this motion used to place or remove the pencil from the device tends to rotate the hat rather than lift it off the head. If one rotates a hat on ones heat it is soon evident that the sweat band remains in contact with the head. This allows the friction of the sweat band and the head to overcome the friction of the device on the pencil. This then permits the pencil to be removed without seriously disturbing the position of the hat on the wearer's head. Thus, the hat may be worn rather loosely, a big advantage on a hot day.

Another problem presented by the soft cap is that there is not solid top surface to slide the pencil down to automatically guide it into the holder as on a hard hat mentioned in Jensen U.S. Pat. No. 2,345,051 and Renaud U.S. Pat. No. 5,066,154. The only firm surface on a soft cap is the visor on the sweat band area when the hat is on the head. Prior art seems to have no holders that could utilize these surfaces to their full advantage. Most of the current holders require that the pencil be placed with a downward motion causing the pencil to be parallel with the visor. When an attempt is made to insert the pencil without the firm guiding surface, it would snag between the top end of the clip and the hat's fabric or miss the holder altogether. If the pencil rests in the holder parallel to the floor (Seebol and Hurwitz, Antonucci, Salamone, Barry), upon removal it is subject to interference. It becomes difficult to grasp because the visor of the hat or the temple bar of the glasses gets in the way potentially causing one to fumble the pencil (Antonucci Aug. 1, 1989).

Soft baseball type hats are used world wide to advertise firms and products. The head is a desired area to display such advertisements because it is essentially at the viewer's eye level. However the hats can be expensive. This invention can be used to prominently display printed words or images or any baseball hat, sun visor or safety eyeglasses. The outer surface of the invention is essentially flat and of adequate dimension, 1.0"–1.5" high and 1.0"–2.0" wide, making it ideal to display advertisements while performing a needed function. This invention would be a major cost saving advantage to smaller companies who may be unable to afford the much more expensive hat.

Thus it would appear that there is a need for a pencil holder that detachably mounts on a soft baseball type hat. Furthermore, there is a need for such a holder to truly mimic the traditional motion of placing a pencil on the ear or under the headband of the cap so as to be user friendly. Still further, there is a need for a holder that will secure a pencil at a familiar angle similar to that of a pencil under a baseball cap making it very easy to grasp. And further still, a holder that detachably mounts to a pair of safety type eyeglasses with all the above mentioned attributes of the aforementioned pencil holder.

OBJECTIVES AND ADVANTAGES

Accordingly, it is an object of the present invention.

(a) to provide a pencil type holder that will detachably mount to a soft baseball type hat and will hold a standard pencil, carpenter's pencil or a stick pen;

(b) to provide a firm base for such a holder with means to guide the pencil effortlessly into and out of the holding area;

(c) to provide said base with a means to prevent the pencil from snagging between the end of said base and the soft fabric of the hat;

(d) to provide said base with a means of attachment to the sweat band area of said hat such that the top end of said base will firmly press into the fabric of the cap's side;

(e) to provide a holder with a simple snap off means to adjust the fit on soft hats.

(f) to provide a means by which the pencil can be secured to said base;

(g) to provide a means by which the pencil can be introduced and secured at an angle and with a motion mimicking the traditional angle, approximately 135 degrees to the sweatband, of a pencil secured between the sweat band of the soft cap and the user's head;

(h) to provide a means for said pencil holder to accommodate both left and right handed users;

(i) to provide said holder with a highly visible, printable advertisement surface.

Other objects and features of the present invention will become apparent from the following detailed description considered in connection with the accompanying drawings which disclose one of the embodiments of the present invention. However, it should be understood that the drawings are designed for the purpose of illustration only and not as a definition of the limits of the invention.

DESCRIPTION OF DRAWINGS

FIG. 1 shows invention attached to the right hand side of a soft baseball type hat.

FIG. 2 shows rear view of right hand mounted invention with standard pencil.

FIG. 2A shows front view of right hand mounted invention with carpenter's pencil.

FIG. 2B shows rear view of right hand mounted invention.

FIG. 2C shows rear view of left hand mounted invention.

SUMMARY

Figure 3:
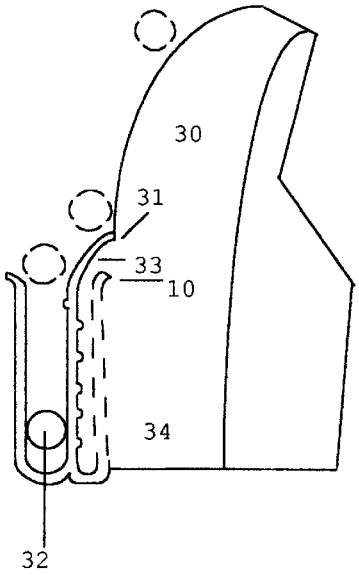
FIG. 3 shows front through view of invention mounted on right hand side of cap.
Figure 3A:
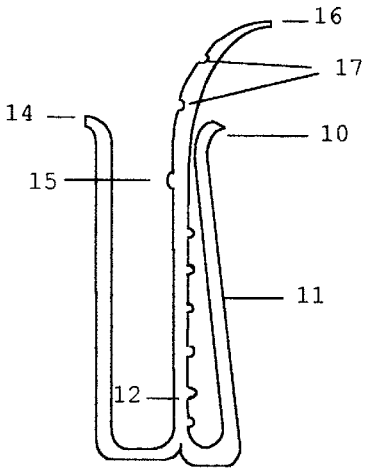
FIGS. 3A & 3B show a through view of the invention.
Figure 3B:
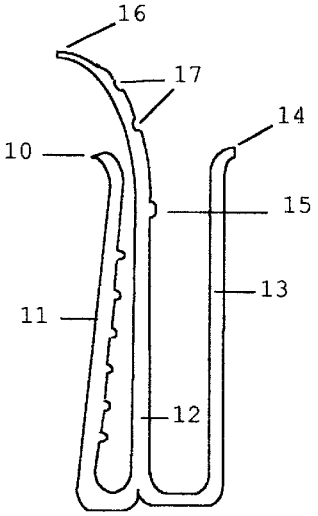
Figure 4:
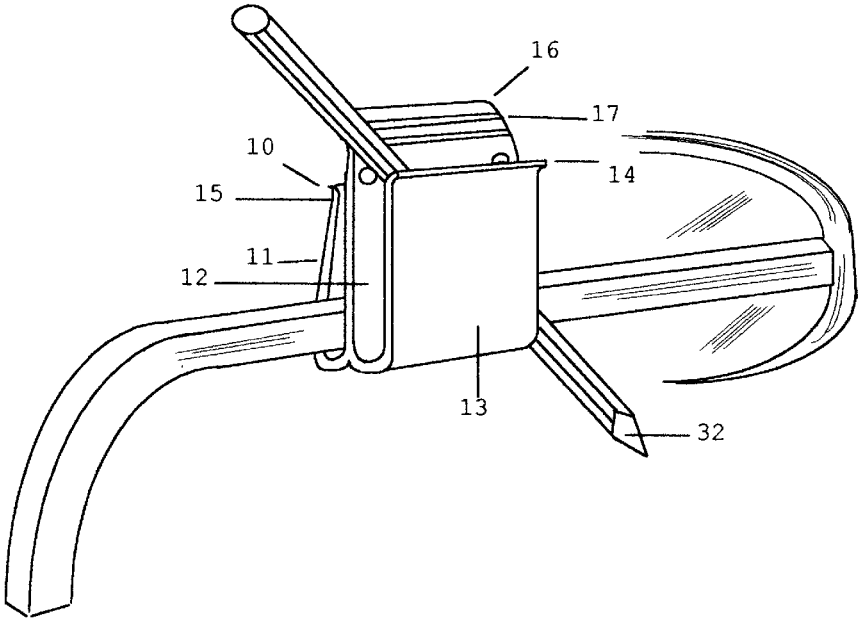
FIG. 4 shows invention in isometric view on temple bar of eyeglasses.

A pencil holder that detachably mounts to the sweatband area of a soft baseball hat comprising a one piece elongated moulded structure having first an upwardly extending, straight, flat surface middle or base section arm, a second opposing inner arm extending downwardly, then inwardly and upwardly to grip the sweat band, and a third opposing outer arm extending outwardly and upwardly from the bottom of, and substantially parallel to, the base section arm to form a U formed holder in which the pencil is frictionally secured at points along said pencil's two sides, said sides being 180 degrees opposite each other.

DESCRIPTION OF PREFERRED EMBODIMENT

For purposes of clarity, inward refers to a direction toward the hat. Outward refers to a direction away from the hat. Referring more specifically to the drawing, the implement holder in it's entirety and comprising the invention is designated generally in the isometric. FIG. 2 and is preferably formed in one piece of moulded plastic and comprises a straight, flat surfaced, base section arm 12, a straight, flat surfaced, opposing outer arm 13 and an inwardly and upwardly extending opposing inner arm 11, all of which extend end to end of the holder, forming in essence, two upwardly facing clamps or clips.

A flat, straight section of base section arm 12 extends upwardly and substantially parallel to the flat surfaced outer arm 13. At a point slightly above and opposite the outwardly arced end of outer opposing arm 13 and slightly above resting nubs 15, on base section arm 12, said base section arm 12 arcs or angles inwardly toward cap 30 at an angle such that it causes the end 16 of said base section arm 12 to terminate in the area of 31 where it comes in firm contact with and depresses fabric of, said cap 30, providing means to form, in conjunction with said hat's sunvisor, a snag free surface along which pencil 32, FIG. 1 will glide into position, FIG. 3, without snagging between base section arm end 16 and fabric of cap 30 in the general area of 33. The action used to place the pencil in the U form, FIG. 1 and FIG. 3 substantially mimmics the user action employed to place a pencil under the sweatband of a hat or on the ear of the user. The top section of base section arm 12 can have two or more V type grooves 17 running from end to end of said base section arm 12. These grooves facilitate a snap off action used to shorten the top of said base section arm 12 to insure a proper fit on the hat.

The flat, straight section of base section arm 12 forks and extends downwardly, curves outwardly, and back upwardly to form opposing outer arm 13 which, in conjunction with said base section arm 12, forms a U formed holder. Opposing outer arm 13 continues upwardly and substantially parallel to base section arm 12 terminating at an outwardly and upwardly arced end 14. Said U formed holder provides two opposing, flat inner surfaces on 13 and 12, such that said pencil can be frictionally secured at various angles between said holder arms 13 and 12 at points along said pencil's two sides, said sides being 180 degrees opposite each other. Said pencil can be introduced into said U formed holder by gliding said pencil, at a naturally occurring angle, along the hat visor or the side of the hat, whereby substantially mimicking the familiar user motion of placing the pencil under the sweatband of a baseball hat.

The flat, straight section of base section arm 12, FIG. 2, forks and extends downwardly and curves inwardly and back upwardly to form opposing inner arm 11 which, in conjunction with base section arm 12, forms a clamping or clip type holder. Opposing inner arm 11 extends upwardly under and in close proximity to the arced top of said base section arm 12 on the inner or hat side of said base section 12. Said clamping or clip type holder with opposing arms 11 and 12, provide means whereby a hat's sweatband 34, FIG. 3, can be introduced into and frictionally secured between the holder arms. The distance between said opposing inner arm 11 and said base section arm 12 at the inside bottom of said clamping or clip type holder is slightly greater than the slightly compressed thickness of a sweatband of a baseball hat.

Two outwardly protruding nubs 15 are moulded into or stamped into the flat, straight section 12 slightly below the beginning of the inward arc on base section arm 12 which terminates at 16. Said nubs 15 are longitudinally disposed, one near the rearward and one near the forward end of said base section arm 12 such that the rear section of pencil 32 can, while frictionally held between 13 and 12, rest atop the rear nub 15 and the front section of said pencil can rest on or near the bottom front edge of said U formed holder therefore providing means to rest said pencil firmly at an angle of approximately 135 degrees to the horizontal, longitudinal bottom of said U formed holder. It should be noted that this is but one of a plurality of means to dispose pencil at said angle.

Various changes and variations are foreseen and may be implemented, without departing from the true scope or function of the invention.

I claim as my invention:

1. A detachable pencil holder to mount on the sweatband area of a soft baseball hat, the holder comprising:

a one piece elongated moulded structure having first an upwardly extending straight, flat surfaced middle base section arm, the top of said base section arm being inwardly arced toward said hat;

a second opposing inner arm extending downwardly from the bottom of said base section arm, then curving inwardly and then curving back upwardly, in close proximity to and under the inwardly arcing top of said base section arm, to form, in combination with said base section arm, a clamping clip type holder for providing means to detachably mount said base section arm to the sweat band area of said hat in such manner that the inwardly arced top end of said base section arm is in firm contact with and depresses the surface of, the fabric of said hat, for providing means to form in conjunction with said hat, a smooth, snag free surface along which a pencil will glide thereon.

a third opposing outer arm extending outwardly and upwardly from the bottom of, and substantially parallel to, said base section arm to form a straight walled, flat surfaced U formed holder providing means by which said pencil can be secured at various angles, by friction, at points along said pencil's two sides, said sides being 180 degrees opposite each other, between the opposing outer arm and the base section arm of said U formed holder.

2. A holder as in claim 1, said base section arm having two protruding nubs, one forward and one rearward, disposed longitudinally and slightly below the inwardly angled or arced section of said base section arm providing means for said pencil to rest firmly at an angle of approximately 135 degrees to the horizontal, longitudinal bottom of said U formed holder.

3. A holder as in claim 1, said base section arm having 2 or more longitudinal "V" grooves, disposed near the top of said base section arm and extending end to end of said holder, causing division of said top of said section arm base into two or more removable segments.

4. A holder as in claim 1, said opposing inner arm terminating at an inwardly and upwardly arced end on the hat side of, and in close proximity to, said base section arm.

5. A holder as in claim 1, said snag free surface and the visor of said hat, in conjunction with said U form holder, comprise guiding means by which said pencil can be introduced into said U formed holder by gliding said pencil along said visor and said snag free surface at a naturally occuring angle whereby substantially mimicking the familiar placement action of user to place a pencil under a baseball hat or on the ear.

6. The clamping clip type holder of claim 1 providing means to detachably mount said base section arm to the sweat band area of said hat, the distance between said second opposing inner arm and said base section arm at the inside bottom of the closed end of said clamping type holder is slightly greater than the thickness of a slightly compressed sweatband of a base ball hat.

* * * * *